US007607820B2

(12) United States Patent
Krzywdziak

(10) Patent No.: US 7,607,820 B2
(45) Date of Patent: Oct. 27, 2009

(54) STIRRING DEVICE FOR A PAINT POT, WITH MODIFIABLE FUNCTIONS, IN A PLASTIC MATERIAL

(75) Inventor: Alain Krzywdziak, Orleans (FR)

(73) Assignee: Dedoes Industries, Inc., Walled Lake, MI (US)

( * ) Notice: Subject to any disclaimer, the term of this patent is extended or adjusted under 35 U.S.C. 154(b) by 690 days.

(21) Appl. No.: 11/355,422

(22) Filed: Feb. 16, 2006

(65) Prior Publication Data

US 2006/0185524 A1 Aug. 24, 2006

(30) Foreign Application Priority Data

Feb. 18, 2005 (FR) ..... 05 1700

(51) Int. Cl.
*B01F 7/20* (2006.01)

(52) U.S. Cl. ..... 366/247

(58) Field of Classification Search ..... 366/244, 366/245, 246, 247, 250, 251, 252; 403/359.1, 403/359.5, 332, 375; 464/901
See application file for complete search history.

(56) References Cited

U.S. PATENT DOCUMENTS 874,292 A * 12/1907 Blackford ..... 366/246
1,026,970 A * 5/1912 Woodruff ..... 366/246
1,428,438 A * 9/1922 Mcbride ..... 366/246
4,012,155 A * 3/1977 Morris ..... 403/290
4,079,917 A * 3/1978 Popeil ..... 366/244
4,380,399 A * 4/1983 Godat et al. ..... 366/289
5,143,500 A * 9/1992 Schuring et al. ..... 411/339
5,201,263 A * 4/1993 Teng ..... 99/335
5,482,370 A * 1/1996 Dedoes ..... 366/247
5,498,077 A * 3/1996 Krzywdzjak et al. ..... 366/247
5,516,208 A * 5/1996 Givant ..... 366/251
5,816,136 A * 10/1998 Stallings ..... 99/335
6,582,151 B2 * 6/2003 Hopson ..... 403/359.5
6,857,247 B2 * 2/2005 Adams ..... 52/656.9
6,886,974 B1 * 5/2005 Millan et al. ..... 366/191

* cited by examiner

*Primary Examiner*—Tony G Soohoo
(74) *Attorney, Agent, or Firm*—Gifford, Krass, Sprinkle, Anderson & Citkowski, P.C.

(57) ABSTRACT

A stirring device (50) for fitting to measuring-out lids that include a central orifice and that can be adapted to cylindrical paint pots with a top opening.

This device is composed of two parts in different plastic materials joined together by means of an assembly system (30), the first part being a modifiable, interchangeable drive system (10) mounted to rotate in the central orifice, and the second part being a stirring system of the shaft and stirrer-blade type (20) that can be adapted to the size of the pot.

14 Claims, 6 Drawing Sheets

STIRRING DEVICE FOR A PAINT POT, WITH MODIFIABLE FUNCTIONS, IN A PLASTIC MATERIAL

BACKGROUND OF THE INVENTION

I. Field of the Invention

This present invention relates to the area of the stirrers for paint pots or similar. The invention most particularly concerns a stirring device with modifiable functions, which can be fitted to the measuring-out lid of a stirring machine for paint pots.

II. Description of Related Art

We are already familiar, from previous designs, with stirring systems for mounting on the measuring-out lid of a stirring machine which, in the area of vehicle bodywork, are composed of a gearwheel, a shaft and stirrer blades. In general the gearwheel and the blades are made from a plastic material, moulded onto the shaft. In the case of the shaft, which is subjected, when rotating, to a rubbing action against the lid, the choice of the material is more important. In order to circumvent the effects of surface melting when using a plastic material, which leads to the adherence of the shaft to the lid, it is now common to use metal rods. These metal rods allow the use of rotation speeds of 80 to 100 revolutions per minute without any heating phenomenon.

One disadvantage of these metal shaft systems, known from previous designs, concerns the relatively high cost of their manufacture, especially when they are used for water-based paints where, in this case, in order to avoid any oxidation phenomena which could alter the quality of the paint contained in the pot, the metal used for the shaft or axle is stainless steel.

Another disadvantage of these systems, known from previous designs, is that it is often necessary to use an additional adjusting piece in order to fit the stirrer to the drive element. This additional adjusting piece complicates the operation, particularly when it is necessary to change the drive element in order to fit it to another type of stirring machine.

Another disadvantage of these systems, known from previous designs, is that the stirrer is composed of three parts, namely the gearwheel, the shaft and the blades, and this also complicates both manufacture and use of the device.

SUMMARY OF THE INVENTION

This present invention therefore has as its objective to eliminate one or more of the disadvantages of previous designs.

This is achieved with a stirring device for mounting on a measuring-out lid which has a central orifice and which can be fitted to a cylindrical paint pot that includes an opening at the top, composed of two parts, each in a different plastic material, joined together by means of an assembly system, where the first part takes the form of a modifiable, interchangeable drive system mounted to rotate in the central orifice of the lid, and the second part takes the form of a stirring system of the shaft and stirrer-blade type that can be adapted to the size of the pot and which has at least one stirrer blade.

According to one advantageous facet of the invention, this represents a change from a known system with three parts to a system with two parts that is easier to use. The fact that the drive system is interchangeable contributes to the originality of the invention, while also being very practical. Moreover, the use of a plastic material for all of the system considerably reduces costs at the production level.

According to another particular feature of the invention, the modifiable, interchangeable drive system is a single-block part and is composed of a drive element, a shaft with a spigot extremity whose diameter corresponds to that of the central orifice, where the said drive element can be either a gearwheel used to fit onto stirring machines of the alliance type with a toothed-belt or gearwheel drive system, or with a drive coupler used to fit onto palette-type stirring machines, or with a crank used for manual stirring.

According to another particular feature of the invention, the drive system is in a noble material of the polyamide or polyoxymethylene type, and the blade-type stirrer system is in a material of the polypropylene or polymethylene type.

According to another particular feature of the invention, the drive system, when made of polyamide, includes an $MSO_2$ filler of the molybdenum bisulphide type.

According to another advantage of the invention the use of these materials thus avoids surface-melting effects as the shaft rotates and rubs against the lid.

According to another particular feature of the invention, the blade-type stirrer system is of a size that fits for onto pots with a capacity of 0.5, 1 or 3.5 litres.

According to another particular feature of the invention, the blade-type stirrer system has at least two stirrer blades.

According to another particular feature of the invention, the spigot extremity is split at its end in the direction of its length, thus forming two parts whose extremities each have a projecting rim directed toward the outside allowing attachment to the blade-type stirrer system, the shape of the extremity being variable.

According to another particular feature of the invention, the top end of the shaft of the blade-type stirrer system is of the hollow cylindrical type whose diameter, and the shape of the aperture, are adapted to that of the diameter and shape of the extremity of the shaft of the drive system, and includes an opening whose size is matched to that of the projecting rim, allowing the end of the shaft to be click-fitted by moving the parts together in the aperture and inserting of the projecting rims into the opening.

According to another particular feature of the invention, the thickness of the projecting rim is equal to or greater than that of the cylinder.

According to another advantage of the invention the elastic quality of the plastic favours the bringing together of the two ends of the shaft, allowing the extremity of the shaft to be click-fitted into the aperture in the shaft of the blade system and allowing insertion of the projecting rims, whose thickness is equal to or greater than the thickness of the cylinder, into the opening of the shaft. Thus by a simple pressure on the part of the projecting rims trapped in the opening, it is possible to unclip the upper part of the device and very simply change the drive system.

According to another particular feature of the invention, the shape of the extremity of the shaft and of the hollow is not totally circular.

BRIEF DESCRIPTION OF THE DRAWING

The invention, with its characteristics and advantages, will be understood more clearly on reading the following description, which is provided with reference to the appended drawings, given by way of examples, in which.

The invention will now be described with reference to FIGS. 1 to 6.

DETAILED DESCRIPTION OF A PREFERRED EMBODIMENT OF THE INVENTION

Although the invention may have been described for application to paint pots in particular, the stirring device (50) can be adapted to suit other types of receptacle employed for mixing, as well as other types of lid.

Figure 1:
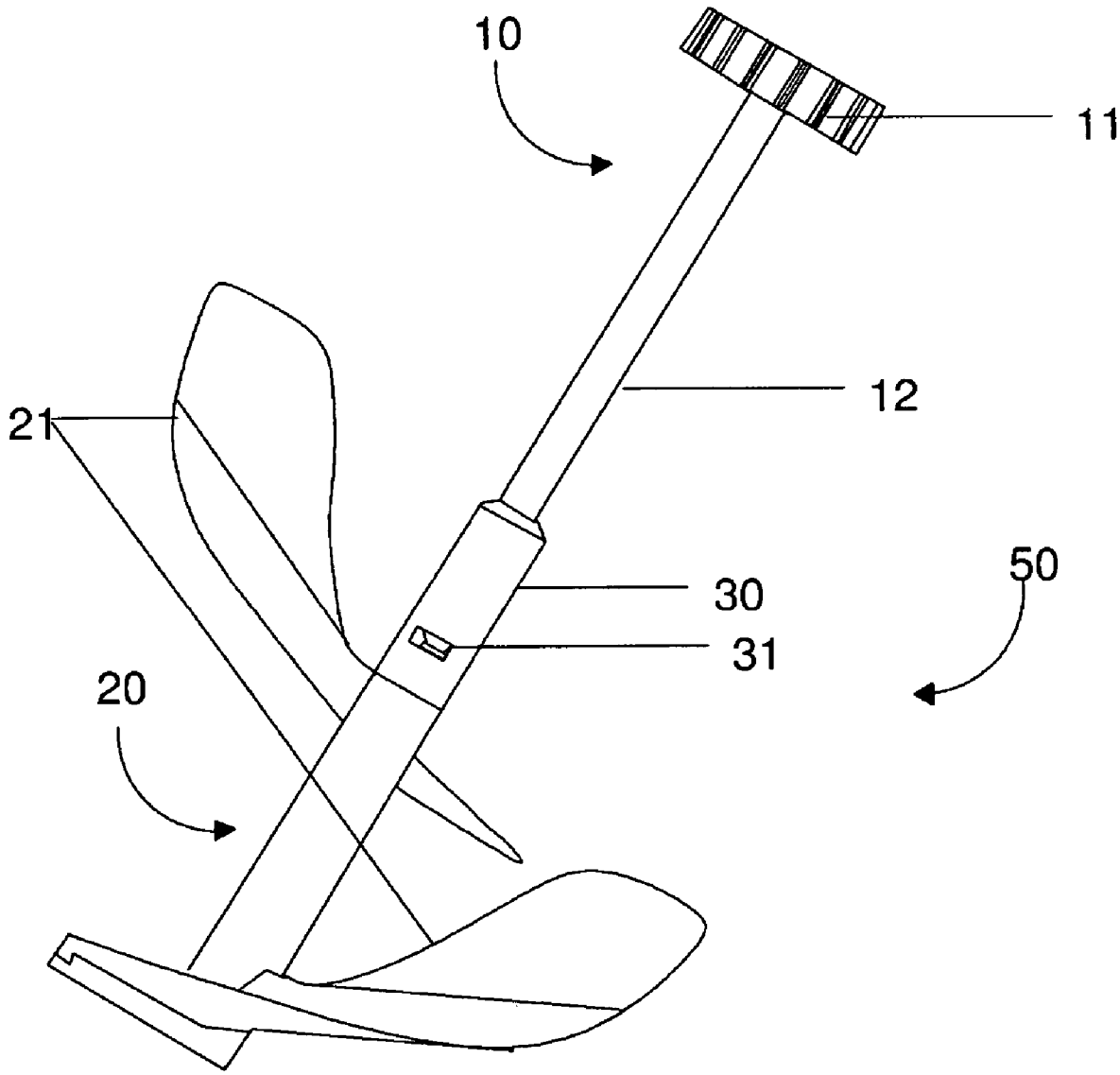
FIG. 1 is a view in elevation showing one possible method of implementation of the invention.

As shown in FIG. 1, the stirring device (50) is composed of two different parts.

Figure 4:
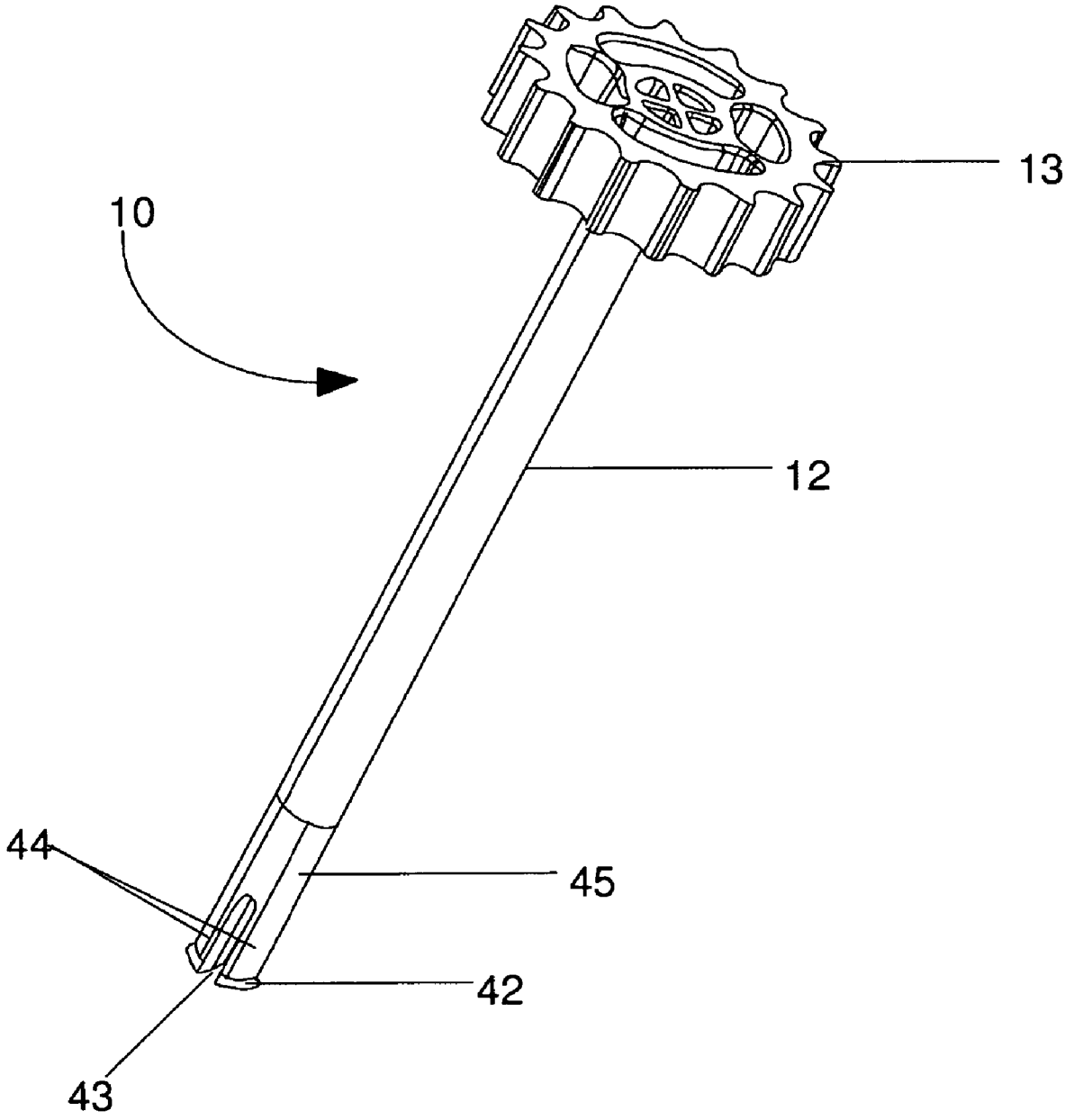
FIG. 4 is a view in elevation showing a first drive system according to the invention.
Figure 5:
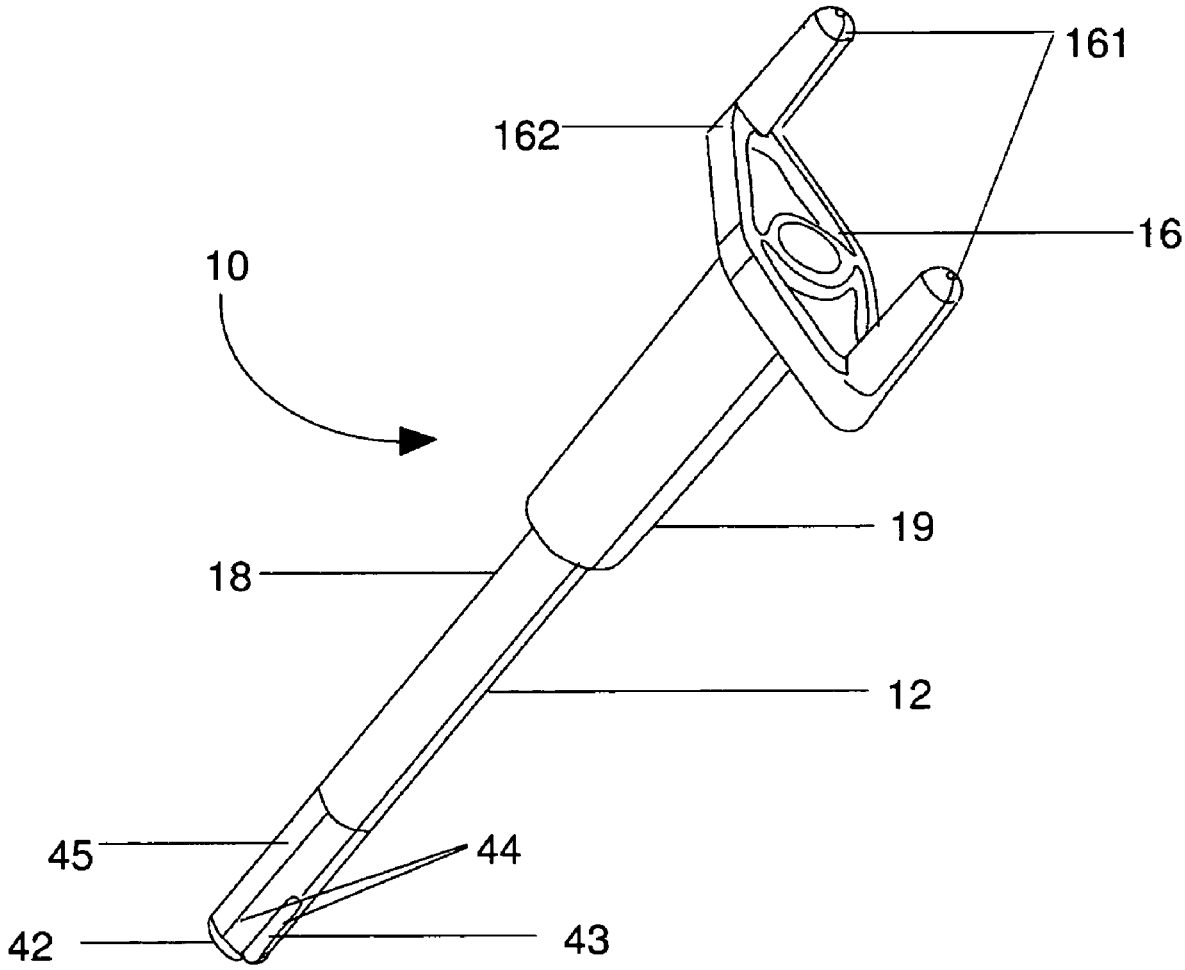
FIG. 5 is a view in elevation showing a second drive system according to the invention.
Figure 6:
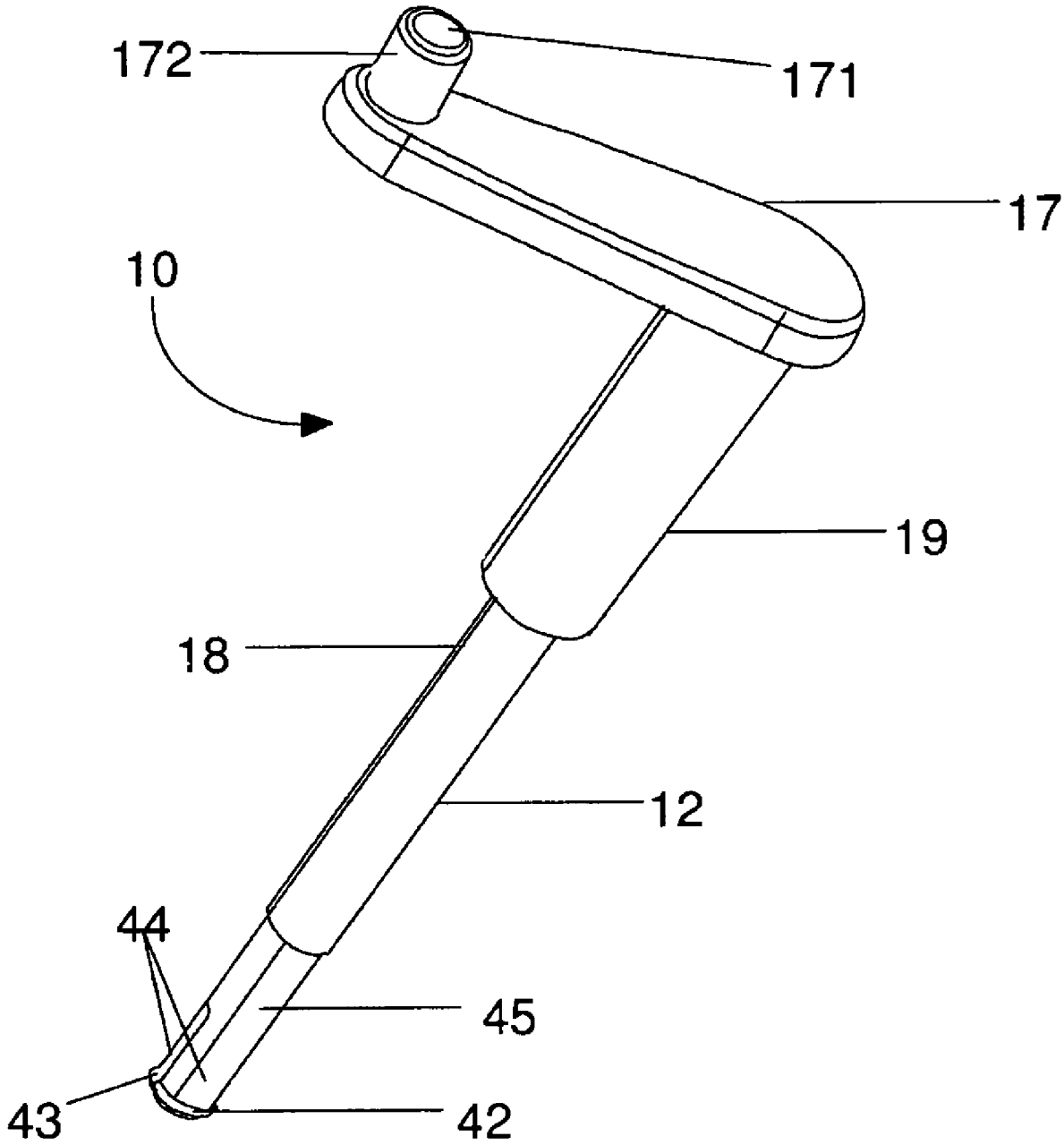
FIG. 6 is a view in elevation showing a third drive system according to the invention.

The first part is composed of the drive system (10). This system is composed of a cylindrical shaft (12) that can rotate during the stirring process, and of a drive element (11) which can change according to the type of stirring machine employed. FIG. 4 shows a drive element of the gearwheel type composed of a shaft (12) and a gearwheel (13), which will allow the device to be adapted to a stirring machine of the alliance type which includes a toothed-belt or gearwheel drive system. FIG. 5 illustrates a drive element of the drive coupler type, composed of a shaft (12) and a drive coupler (16) with fingers (161) mounted at each end of a radial support element (162). The fingers (161) are oriented away from the shaft axis (18) in relation to the radial support (162). In this case, the said drive coupler will allow adaptation to a machine of the palette type. FIG. 6 shows a drive element of the crank type (17), having at its end a pin (171) surrounded by a capstan (172) allowing rotation of the stirring device when used for manual stirring. By grasping the capstan (172), it is then possible to turn the crank manually. In FIGS. 5 and 6, the shaft (12) is composed of two cylinders of different diameter. The upper cylinder (19) has a diameter that is greater than that of the lower cylinder (18). In order to avoid surface-melting effects, the materials used for the drive element are noble materials of the polyamide or polyoxymethylene type, with an $MOS_2$ type filler of molybdenum bisulphide when polyamide is employed.

Figure 2:
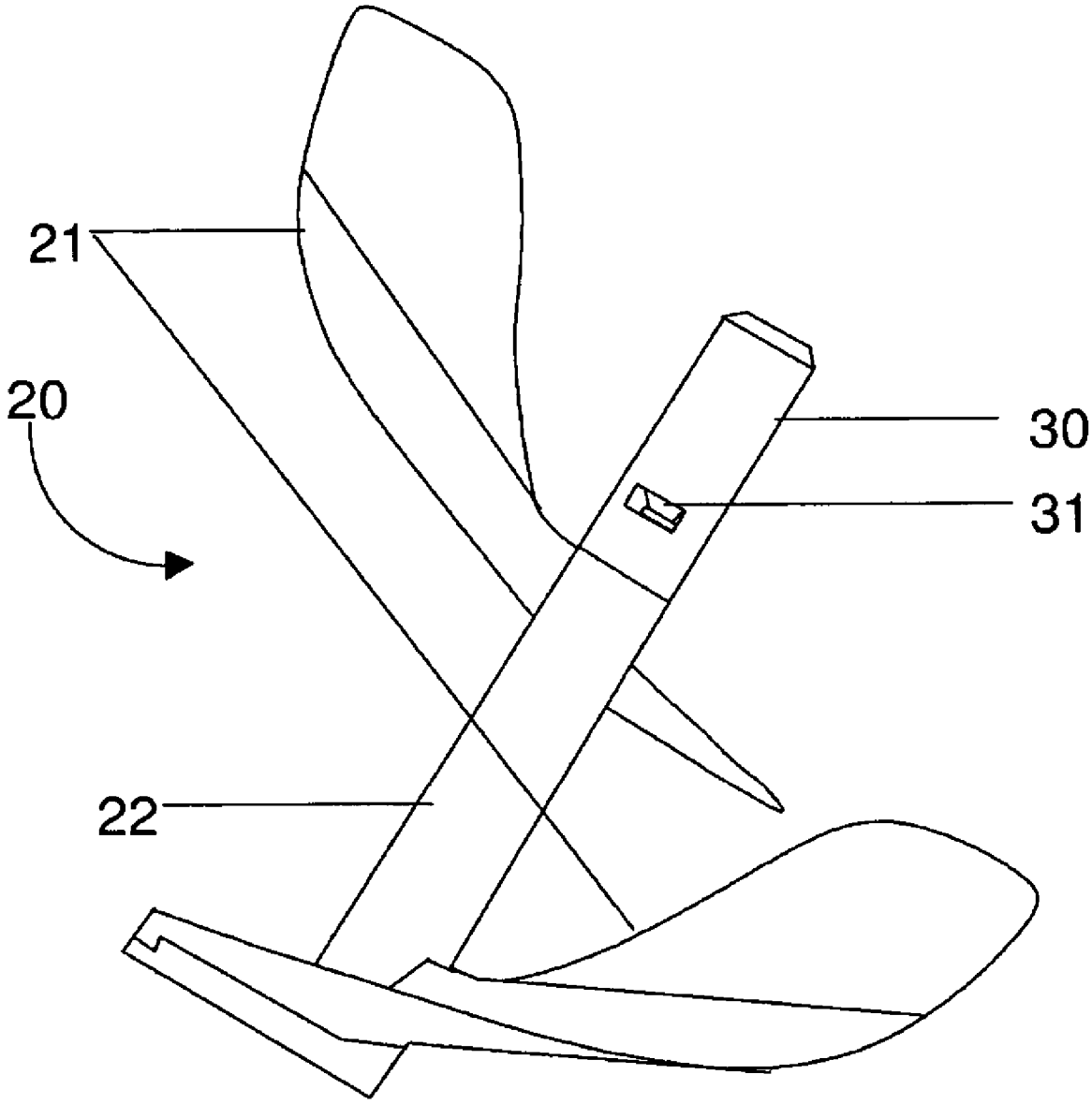
FIG. 2 is a view of the stirrer-blade system capable of accepting any one of the three adaptation devices.
Figure 3:
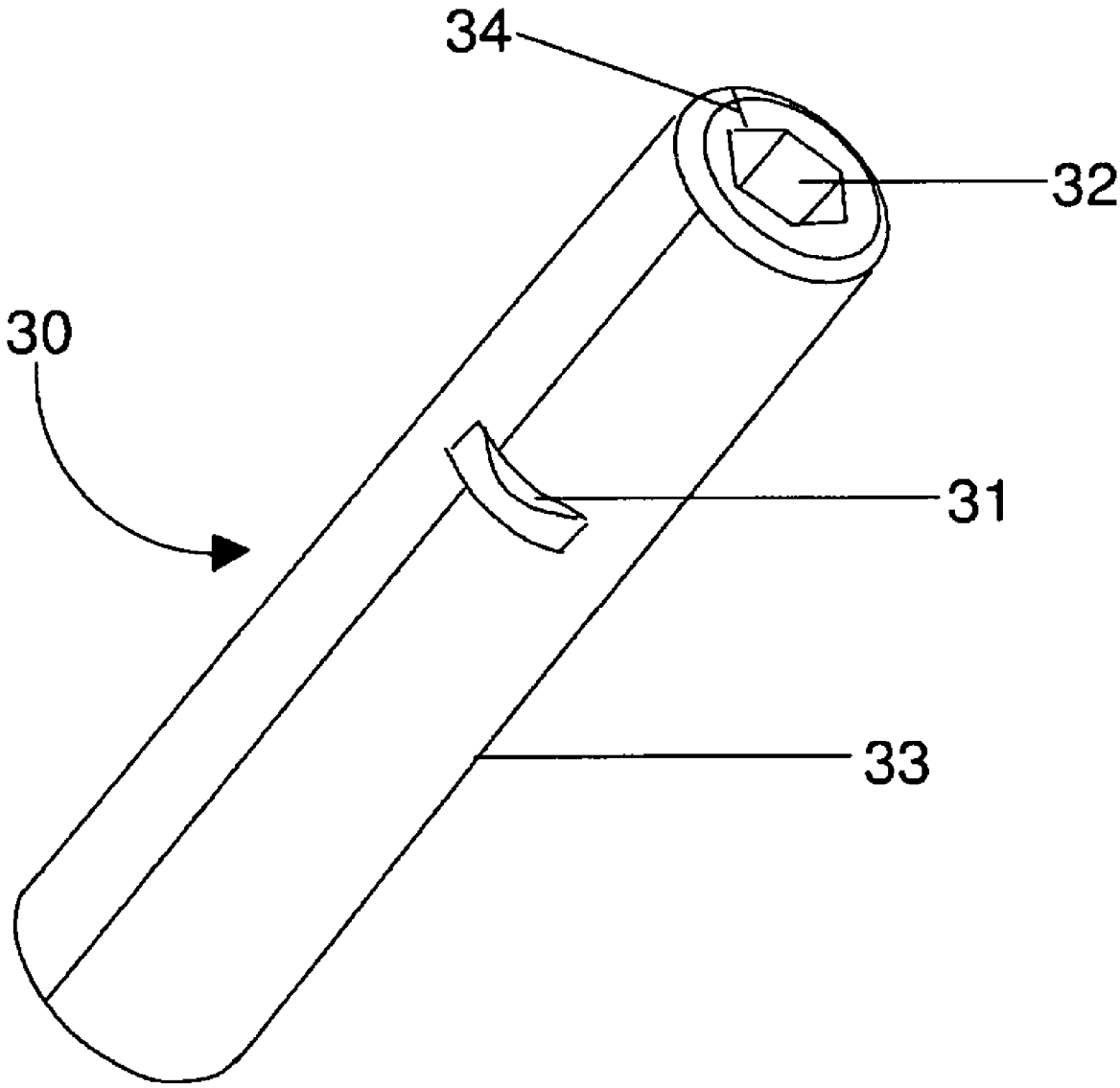
FIG. 3 is a view of the portion of the stirrer-blade system used for the assembly process.

The second part of the stirring device is the stirring system (20). This system, illustrated in FIG. 2, is composed of a shaft (22) on at least one stirrer blade is mounted, these two elements being in a plastic material of the polypropylene or polymethylene type. In a preferred implementation of the invention, the shaft has two stirrer blades. The size of this system is designed to suit pots of different capacity. In a preferred method of implementation of the invention, the capacity of the pots is 0.5, 1 and 3.5 litres. As shown in FIG. 3, the extremity of the shaft (33) is hollow (32), and has one opening (31).

Each of the different drive systems shown in FIGS. 4, 5 and 6, includes, at their lower extremity (45), a slot (43) dividing the shaft (12) into two parts (44). Each of the two parts has at its end a projecting rim (42) that is orientated toward the outside. The size of the opening (31) on the shaft is slightly greater than that of the projecting rim (42) so that the latter can be inserted into the opening. The thickness of the projecting rim (42) is equal to or greater than the thickness of the cylinder (34) in the opening of the shaft, to allow the upper part of the device to be unclipped and the drive system to be changed. The shape of the extremity (45) and of the aperture (32) is not totally circular, and can have the shape of a polygon or half cylinder.

It should be obvious to the professional engineer that this present invention allows methods of implementation in many other specific forms without moving outside of the area of application of the invention as claimed. As a consequence, the methods of implementation mentioned here should be taken and illustrations only, and capable of being modified within the area defined by the scope of the attached claims, and the invention should not be considered as being limited to the details given above.

I claim:

1. A stirring device for mounting on a measuring-out lid that has a central orifice and that can be adapted to a cylindrical paint pot having a top opening, said stirring device comprising first and second parts in different plastic materials and joined together by means of an assembly system, the first part forming a drive system mounted to rotate in the central orifice of the lid, and the second part being a stirring system having a shaft and a stirrer blade having at least one stirrer blade dimensioned to fit within the paint pot, wherein said drive system is a single-block part, and comprises a drive element, a shaft and a spigot extremity whose diameter matches that of the central orifice of the lid, wherein said drive element comprises a gearwheel, wherein said spigot extremity is split at its end in the direction of its length, thus forming two parts whose ends each have a projecting rim directed toward the outside and dimensioned for attachment to the blade-type stirrer system.

2. A device according to claim 1 characterised in that the drive system is made from a noble material of the polyamide or polyoxymethylene type, and the blade-type stirrer system is made from a material of the polypropylene or polymethylene type.

3. A device according to claim 2 characterised in that the drive system, when it is in polyamide, includes an $MSO_2$ filler of the molybdenum bisuiphide type.

4. A device according to claim 1 characterised in that the blade-type stirrer system has at least two stirrer blades.

5. A device according to claim 1, characterised in that the top end of the shaft of the blade-type stirrer system is of the hollow cylindrical type whose diameter, and the shape of the aperture, are matched to the diameter and shape of the extremity of the shaft of the drive system and has an opening whose size is matched to that of the projecting rim, allowing the end of the shaft to be click-fitted by moving the parts together in the aperture and inserting the projecting rims into the opening.

6. A device according to claim 5, characterised in that the shape of the extremity of the shaft and of the hollow is not totally circular.

7. A device according to claim 1, characterised in that the projecting rim has a thickness that is equal to or greater than that of the cylinder.

8. A stirring device for mounting on a measuring-out lid that has a central orifice and that can be adapted to a cylindrical paint pot having a top opening, said stirring device comprising first and second parts in different plastic materials and joined together by means of an assembly system, the first part forming a drive system mounted to rotate in the central orifice of the lid, and the second part being a stirring system having a shaft and a stirrer blade having at least one stirrer blade dimensioned to fit within the paint pot, wherein said drive system is a single-block part, and comprises a drive element, a shaft and a spigot extremity whose diameter matches that of the central orifice of the lid, wherein the said drive element comprises a drive coupler, wherein said spigot extremity is split at its end in the direction of its length, thus forming two parts whose ends each have a projecting rim directed toward the outside and dimensioned for attachment to the blade-type stirrer system.

9. A device according to claim 8, characterised in that the drive system is made from a noble material of the polyamide or polyoxymethylene type, and the blade-type stirrer system is made from a material of the polypropylene or polymethylene type.

10. A device according to claim 9 characterised in that the drive system, when it is in polyamide, includes an $MSO_2$ filler of the molybdenum bisulphide type.

11. A device according to claim 8 characterised in that the blade-type stirrer system has at least two stirrer blades.

12. A device according to claim 8, characterised in that the top end of the shaft of the blade-type stirrer system is of the hollow cylindrical type whose diameter, and the shape of the aperture, are matched to the diameter and shape of the extremity of the shaft of the drive system and has an opening whose size is matched to that of the projecting rim, allowing the end of the shaft to be click-fitted by moving the parts together in the aperture and inserting the projecting rims into the opening.

13. A device according to claim 12, characterised in that the shape of the extremity of the shaft and of the hollow is not totally circular.

14. A device according to claim 8, characterised in that the projecting rim has a thickness that is equal to or greater than that of the cylinder.

* * * * *

UNITED STATES PATENT AND TRADEMARK OFFICE

CERTIFICATE OF CORRECTION

PATENT NO. : 7,607,820 B2
APPLICATION NO. : 11/355422
DATED : October 27, 2009
INVENTOR(S) : Alain Krzywdziak It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 925 days.

Signed and Sealed this

Twelfth Day of October, 2010

David J. Kappos

David J. Kappos
*Director of the United States Patent and Trademark Office*